US011338583B2

(12) United States Patent
Uchida

(10) Patent No.: US 11,338,583 B2
(45) Date of Patent: May 24, 2022

(54) LIQUID EJECTING HEAD AND LIQUID EJECTING APPARATUS

(71) Applicant: SEIKO EPSON CORPORATION, Tokyo (JP)

(72) Inventor: Kazuaki Uchida, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/942,133

(22) Filed: Jul. 29, 2020

(65) Prior Publication Data

US 2021/0031517 A1 Feb. 4, 2021

(30) Foreign Application Priority Data

Jul. 31, 2019 (JP) ..... JP2019-140487

(51) Int. Cl.
*B41J 2/14* (2006.01)
*B41J 2/175* (2006.01)

(52) U.S. Cl.
CPC ..... *B41J 2/14233* (2013.01); *B41J 2/14201* (2013.01); *B41J 2/17563* (2013.01); *B41J 2002/14241* (2013.01); *B41J 2002/14419* (2013.01); *B41J 2202/12* (2013.01)

(58) Field of Classification Search
CPC ..... B41J 2/14233; B41J 2/14201; B41J 2002/14419; B41J 2202/12; B41J 2002/14241; B41J 2/17563; B41J 2/18
See application file for complete search history.

(56) References Cited

U.S. PATENT DOCUMENTS 8,851,639 B2 * 10/2014 Arimoto ..... B41J 2/175 347/85
2013/0233939 A1 9/2013 Uezawa
2017/0239946 A1 8/2017 Nakagawa

FOREIGN PATENT DOCUMENTS

| | | |
|---|---|---|
| JP | H02-500584 | 3/1990 |
| JP | 2013-184372 | 9/2013 |
| WO | 1989-002577 | 3/1989 |

* cited by examiner

*Primary Examiner* — Geoffrey S Mruk
(74) *Attorney, Agent, or Firm* — Workman Nydegger

(57) ABSTRACT

A liquid ejecting head includes a first individual flow path and a second individual flow path that are adjacent to each other, a first common liquid chamber and a second common liquid chamber. In the first individual flow path, a first communication flow path extending between the first common liquid chamber and a first nozzle, and an inertance of the first communication flow path is smaller than an inertance of a second communication flow path extending between the second common liquid chamber and the first nozzle. In the second individual flow path, a third communication flow path extending between the second common liquid chamber and a second nozzle, and an inertance of the third communication flow path is smaller than an inertance of a fourth communication flow path extending between the first common liquid chamber and the second nozzle.

11 Claims, 10 Drawing Sheets

LIQUID EJECTING HEAD AND LIQUID EJECTING APPARATUS

The present application is based on, and claims priority from JP Application Serial Number 2019-140487, filed Jul. 31, 2019, the disclosure of which is hereby incorporated by reference herein in its entirety.

BACKGROUND

1. Technical Field

The present disclosure relates to a liquid ejecting head and a liquid ejecting apparatus.

2. Related Art

Hitherto, a liquid ejecting head that ejects a liquid, such as ink, from a plurality of nozzles has been proposed. For example, JP-A-2013-184372 discloses a liquid ejecting head including two nozzle rows in which a plurality of nozzles are arranged. Positions of the nozzles in a direction in which the plurality of nozzles are arranged are different between the two nozzle rows.

In liquid ejecting heads of recent years, there is a very high demand for high density nozzles. In order to form a number of nozzles in a highly dense manner, it is important that flow paths in communication with the nozzles are disposed efficiently. On the other hand, the efficiency related to the ejection of the ink in each nozzle needs to be maintained at a high standard. In known techniques, it is not easy to achieve both efficiency in the arrangement of the flow paths in communication with the nozzles and efficiency related to the ejection of the ink in the nozzles.

SUMMARY

A liquid ejecting head according to a suitable aspect of the present disclosure that overcomes the above issue includes a plurality of nozzles that eject a liquid along a first axis, a row of individual flow paths that includes a plurality of individual flow paths arranged in parallel along a second axis orthogonal to the first axis when viewed in a direction of the first axis, the row of individual flow paths each being provided to a corresponding one of the plurality of nozzles, a plurality of energy generating portions that generate energy to eject the liquid, the plurality of energy generating portions each being provided to a corresponding one of the plurality of nozzles, a first common liquid chamber that is commonly in communication with the plurality of individual flow paths, and a second common liquid chamber that is commonly in communication with the plurality of individual flow paths. The plurality of individual flow paths include a first individual flow path and a second individual flow path that are adjacent to each other in the row of individual flow paths and in the first individual flow path, a first energy generating portion in the plurality of energy generating portions is provided midway of a first communication flow path that communicates the first common liquid chamber and a first nozzle in the plurality of nozzles with each other and an inertance of the first communication flow path is smaller than an inertance of a second communication flow path that communicates the second common liquid chamber and the first nozzle with each other. In the second individual flow path, a second energy generating portion in the plurality of energy generating portions is provided midway of a third communication flow path that communicates the second common liquid chamber and a second nozzle in the plurality of nozzles with each other and an inertance of the third communication flow path is smaller than an inertance of a fourth communication flow path that communicates the first common liquid chamber and the second nozzle with each other.

DESCRIPTION OF EXEMPLARY EMBODIMENTS

First Embodiment

Figure 1:
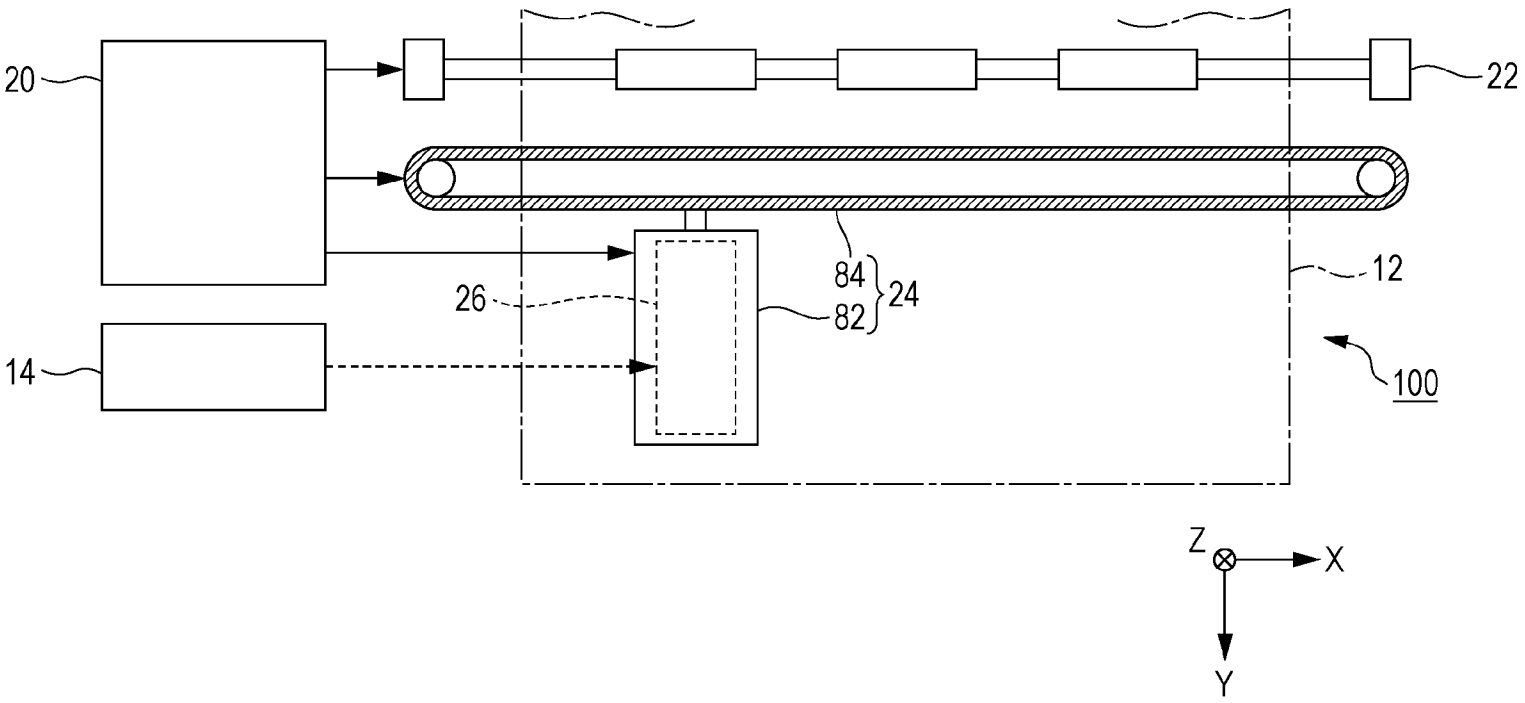
FIG. 1 is a block diagram illustrating a configuration of a liquid ejecting apparatus according to a first embodiment of the present disclosure.

FIG. 1 is a block diagram illustrating an example of a liquid ejecting apparatus 100 according to a first embodiment of the present disclosure. The liquid ejecting apparatus 100 of the first embodiment is an ink jet printing apparatus that ejects ink, which is an example of a liquid, on a medium 12. While the medium 12 is typically printing paper, an object to be printed formed of any material, such as a resin film or fabric, is used as the medium 12. As illustrated as an example in FIG. 1, a liquid container 14 that stores ink is installed in the liquid ejecting apparatus 100. For example, a cartridge configured to detach from the liquid ejecting apparatus 100, a bag-shaped ink pack formed of flexible film, or an ink tank into which ink can be refilled is used as the liquid container 14. A plurality of types of ink of different colors are stored in the liquid container 14.

As illustrated as an example in FIG. 1, the liquid ejecting apparatus 100 includes a control unit 20, a transport mechanism 22, a moving mechanism 24, and a liquid ejecting head 26. The control unit 20 includes a processing circuit such as a central processing unit (CPU) or a field programmable gate array (FPGA) and a memory circuit such as a semiconductor memory, and controls each element of the liquid ejecting apparatus 100 in an integrated manner. The transport mechanism 22 transports the medium 12 in a Y-axis direction under the control of the control unit 20.

The moving mechanism 24 reciprocates the liquid ejecting head 26 in an X-axis direction under the control of the control unit 20. The X-axis intersects the Y-axis along which the medium 12 is transported. Typically, the X-axis and the Y-axis are orthogonal to each other. The moving mechanism 24 of the first embodiment includes a substantially boxshaped transport body 82 that houses the liquid ejecting head 26, and a transport belt 84 to which the transport body 82 is fixed. Note that a configuration in which a plurality of liquid ejecting heads 26 are mounted in the transport body 82 or a configuration in which the liquid container 14 is mounted in the transport body 82 together with the liquid ejecting head 26 can be adopted.

Under the control of the control unit 20, the liquid ejecting head 26 ejects ink, which is supplied from the liquid container 14, onto the medium 12 through a plurality of nozzles. The control unit 20 generates various signals and voltages for ejecting ink from the nozzles and supplies the signals and voltages to the liquid ejecting head 26. The ink is ejected along a Z-axis. The Z-axis is an axis that is perpendicular to a XY plane. In other words, the X-axis and the Y-axis are orthogonal to the Z-axis. The Z-axis is an example of a "first axis", the Y-axis is an example of a "second axis", and the X-axis is an example of a "third axis". Concurrently with the transportation of the medium 12 performed with the transport mechanism 22 and the repetitive reciprocation of the transport body 82, the liquid ejecting head 26 ejects ink onto the medium 12 to form a desired image on a surface of the medium 12.

Figure 2:
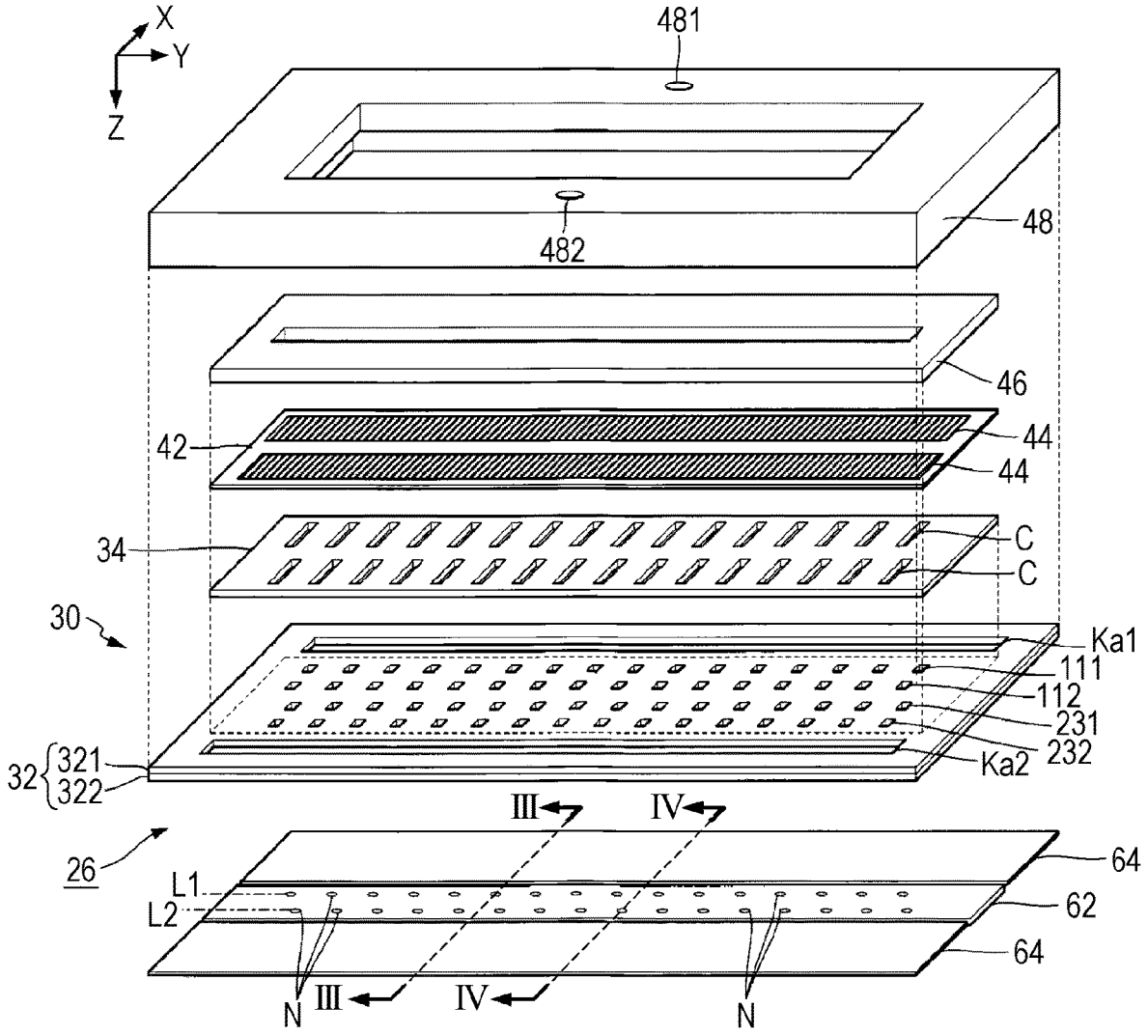
FIG. 2 is an exploded perspective view of a liquid ejecting head.

FIG. 2 is an exploded perspective view of the liquid ejecting head 26. As illustrated as an example in FIG. 2, the liquid ejecting head 26 includes a plurality of nozzles N arranged in the Y-axis direction. The plurality of nozzles N of the first embodiment are divided into a first line L1 and a second line L2 that are parallelly arranged with a space in between in the X-axis direction. The first line L1 and the second line L2 are each a set of a plurality of nozzles N linearly arranged in the Y-axis direction. As illustrated as an example in FIG. 2, positions of the nozzles N of the first line L1 and positions of the nozzles N of the second line L2 are different in the Y-axis. Specifically, when viewed in the X-axis direction, a single nozzle N of the second line L2 is positioned between two adjacent nozzles N of the first line L1.

Figure 3:
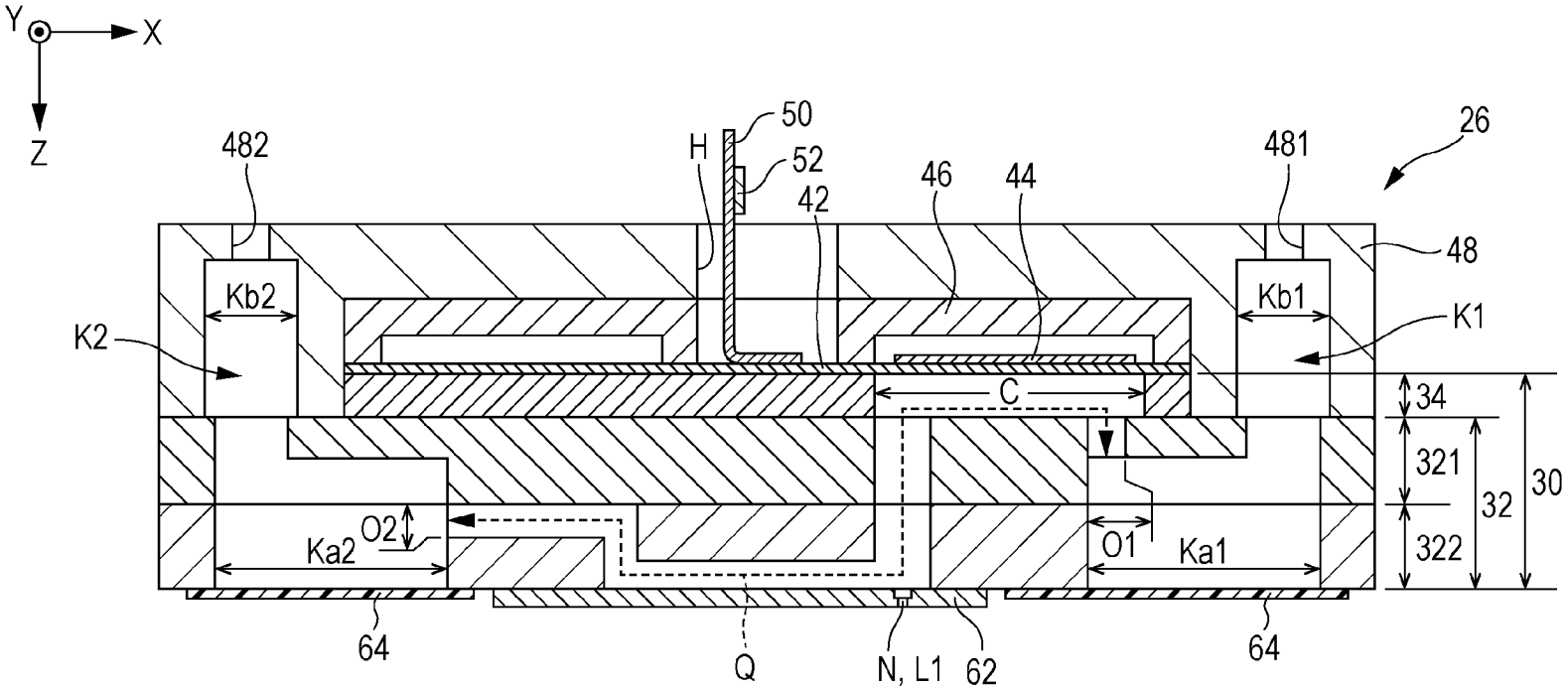
FIG. 3 is a cross-sectional view of the liquid ejecting head.
Figure 4:
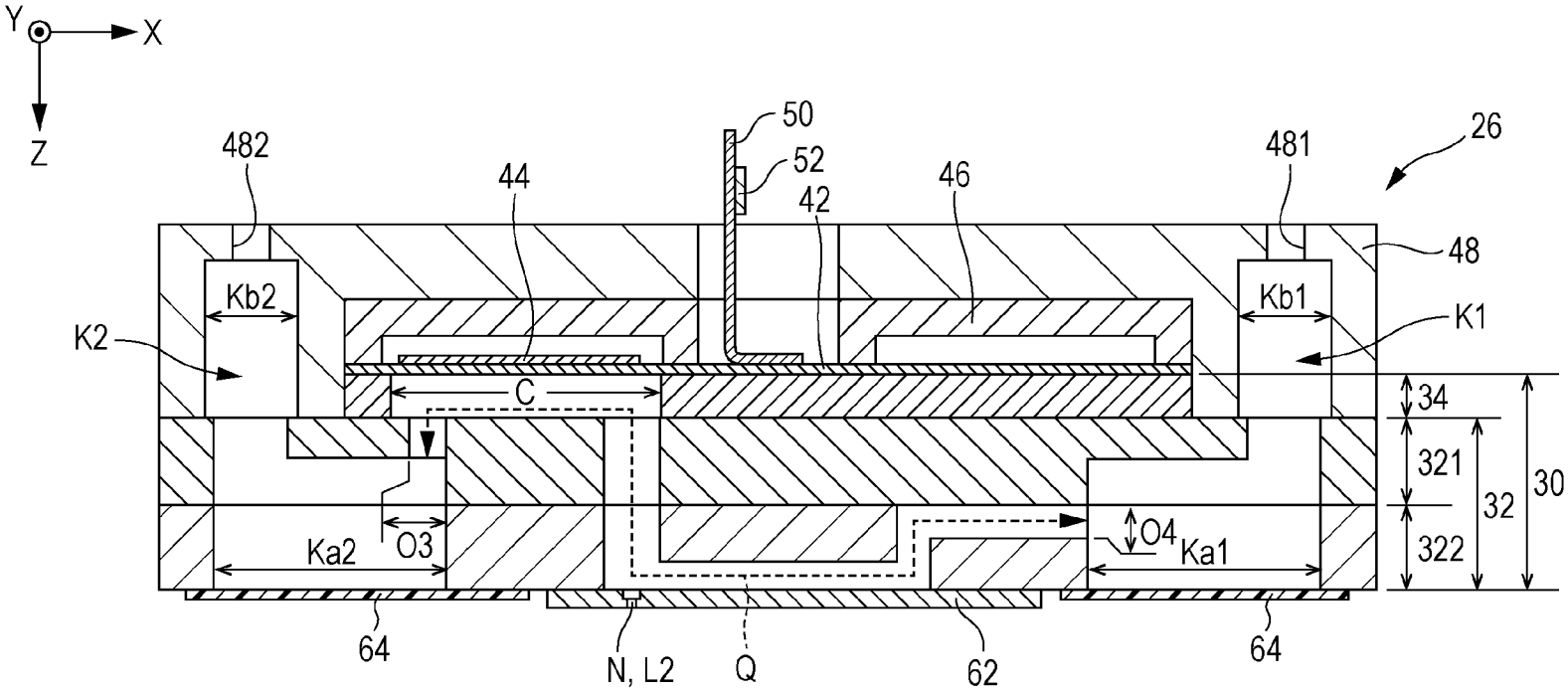
FIG. 4 is a cross-sectional view of the liquid ejecting head.

FIG. 3 is a cross-sectional view taken along line III-III in FIG. 2, and FIG. 4 is a cross-sectional view taken along line IV-IV in FIG. 2. FIG. 3 is a cross-sectional view of elements related to a single nozzle N in the first line L1, and FIG. 4 is a cross-sectional view of elements related to a single nozzle N in the second line L2. As it can be understood from FIGS. 3 and 4, the elements related to each nozzle N of the first line L1 and the elements related to each nozzle N of the second line L2 are in an inverted relationship with respect to a YZ plane.

As illustrated as an example in FIGS. 2 to 4, the liquid ejecting head 26 includes a flow path structure 30. The flow path structure 30 forms flow paths that supply ink to the nozzles N. As illustrated as an example in FIG. 2, a diaphragm 42, a protective substrate 46, and a housing portion 48 are provided in a Z-axis negative direction with respect to the flow path structure 30. On the other hand, a nozzle plate 62 and vibration absorbers 64 are provided in a Z-axis positive direction with respect to a flow path substrate 32. Generally, each element of the liquid ejecting head 26 is a plate-shaped member elongated along the Y-axis and is joined to each other using an adhesive agent, for example.

The nozzle plate 62 is a plate-shaped member in which a plurality of nozzles N are formed and is provided on a surface of the flow path structure 30 in the Z-axis positive direction . Each of the plurality of nozzles N is a circular through hole through which ink passes. In the nozzle plate 62 of the first embodiment, the plurality of nozzles N constituting the first line L1 and the plurality of nozzles N constituting the second line L2 are formed. The nozzle plate 62 is manufactured by processing a single crystal substrate formed of silicon using a semiconductor manufacturing technique such as, for example, dry etching or wet etching. However, any known materials and any known manufacturing methods can be adopted to manufacture the nozzle plate 62.

As illustrated as an example in FIGS. 2 to 4, the flow path structure 30 includes the flow path substrate 32 and a pressure chamber substrate 34. The flow path substrate 32 is positioned in the Z-axis positive direction in the flow path structure 30, and the pressure chamber substrate 34 is positioned in the Z-axis negative direction in the flow path structure 30. As illustrated as an example in FIG. 2, a space Ka1 and a space Ka2 are formed in the flow path substrate 32. The space Ka1 and the space Ka2 are each an opening elongated along the Y-axis. The space Ka1 is formed, in the flow path substrate 32, in an X-axis positive direction, and the space Ka2 is formed, in the flow path substrate 32, in an X-axis negative direction.

The flow path substrate 32 of the first embodiment is formed of layers including a first substrate 321 and a second substrate 322. The first substrate 321 is positioned between the second substrate 322 and the pressure chamber substrate 34. As illustrated as an example in FIGS. 3 and 4, the space Ka1 is formed across the first substrate 321 and the second substrate 322. Similarly, the space Ka2 is formed across the first substrate 321 and the second substrate 322.

The housing portion 48 is a case for storing the ink. A space Kb1 corresponding to the space Ka1 and a space Kb2 corresponding to the space Ka2 are formed in the housing portion 48. The space Ka1 of the flow path structure 30 and the space Kb1 of the housing portion 48 are in communication with each other and the space Ka2 of the flow path structure 30 and space Kb2 of the housing portion 48 are in communication with each other. The space formed by the space Ka1 and the space Kb1 functions as a first common liquid chamber K1, and the space formed by the space Ka2 and the space Kb2 functions as a second common liquid chamber K2. The first common liquid chamber K1 and the second common liquid chamber K2 are each a space commonly formed across a plurality of nozzles N and each store ink supplied to the plurality of nozzles N.

An introduction port 481 and a discharge port 482 are formed in the housing portion 48. The ink is supplied to the first common liquid chamber K1 through the introduction port 481. The ink inside the second common liquid chamber K2 is discharged through the discharge port 482. The vibration absorbers 64 are flexible films constituting wall surfaces of the first common liquid chamber K1 and the second common liquid chamber K2 and absorb the pressure fluctuations of the ink inside the first common liquid chamber K1 and the ink inside the second common liquid chamber K2.

Figure 5:
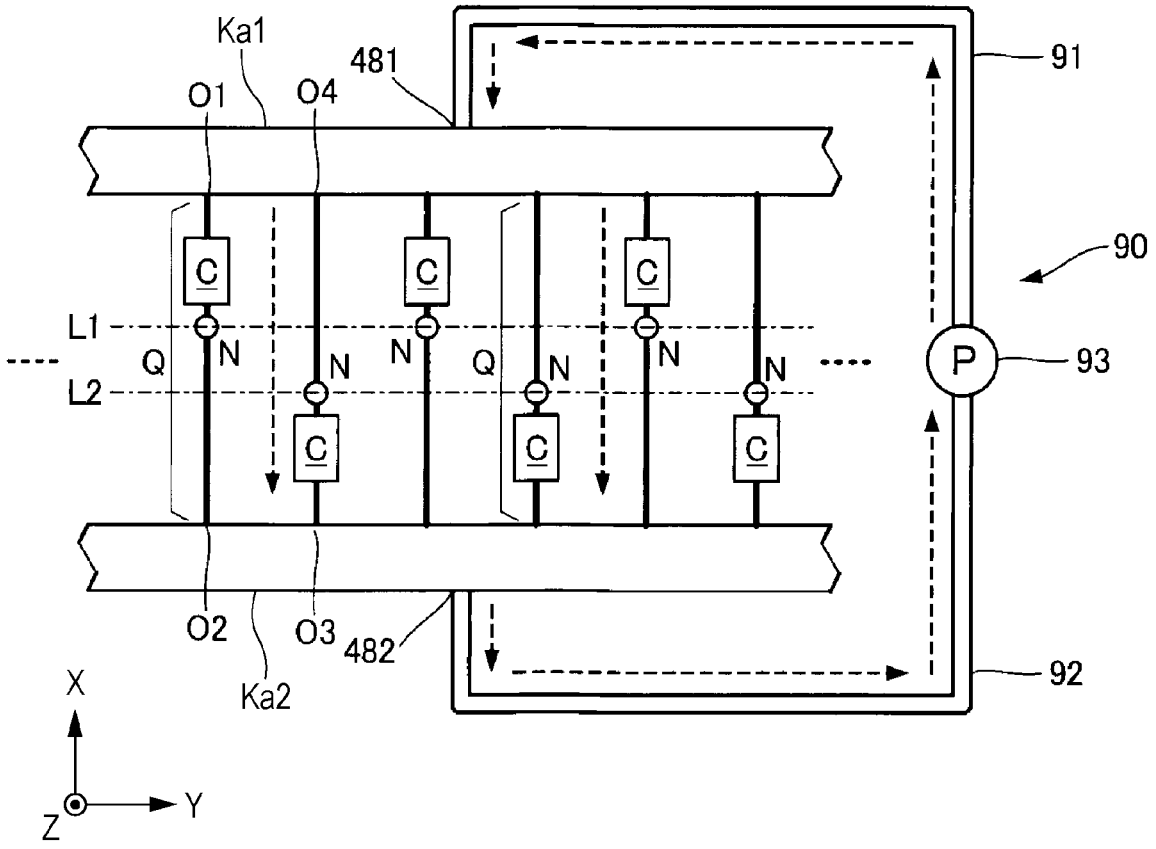
FIG. 5 is a schematic diagram of flow paths formed in the liquid ejecting head.

FIG. 5 is a schematic diagram of the flow paths formed in the liquid ejecting head 26. As illustrated as an example in FIG. 5, an individual flow path Q is formed for each nozzle N in the flow path structure 30. In other words, a plurality of individual flow paths Q are each formed for a corresponding one of a plurality of nozzles N. As illustrated as an example in FIGS. 3 and 4, the nozzles N are formed in the nozzle plate 62 at portions where the wall surfaces of the individual flow paths Q are formed. In other words, each nozzle N is formed so as to branch off from the corresponding individual flow path Q. The first common liquid chamber K1 and the second common liquid chamber K2 are in communication with each other through the individual flow paths Q. Specifically, the individual flow paths Q are formed so that the space Ka1 of the first common liquid chamber K1 and the space Ka2 of the second common liquid chamber K2 communicate with each other. The individual flow paths Q are flow paths formed from an inner wall surface of the first common liquid chamber K1 to an inner wall surface of the second common liquid chamber K2. The individual flow paths Q corresponding to the nozzles N of the first line L1 and the individual flow paths Q corresponding to the nozzles N of the second line L2 are in an inverted relationship with respect to the YZ plane.

As illustrated as an example in FIG. 3, an opening O1, which is a first end portion of the individual flow path Q corresponding to the nozzle N of the first line L1, is formed in an upper surface in inner wall surfaces of the space Ka1, and an opening O2 that is a second end portion is formed in a lateral surface in inner wall surfaces of the space Ka2. It can also be said that the opening O1 is an interface between the individual flow path Q corresponding to the nozzle N of the first line L1 and the inner wall surface of the space Ka1, and the opening O2 is an interface between the individual flow path Q corresponding to the nozzle N of the first line L1 and the inner wall surface of the space Ka2. As illustrated as an example in FIG. 4, an opening O3, which is a first end portion of the individual flow path Q corresponding to the nozzle N of the second line L2, is formed in a lateral surface in inner wall surfaces of the space Ka2, and an opening O4 that is a second end portion is formed in a lateral surface in inner wall surfaces of the space Ka1. It can also be said that the opening O4 is an interface between the individual flow path Q corresponding to the nozzle N of the second line L2 and the inner wall surface of the space Ka1, and the opening O3 is an interface between the individual flow path Q corresponding to the nozzle N of the second line L2 and the inner wall surface of the space Ka2.

As illustrated as an example in FIG. 5, the plurality of individual flow paths Q are arranged in parallel to each other along the Y-axis. In other words, a row of individual flow paths that includes the plurality of individual flow paths Q are formed. Specifically, the individual flow paths Q corresponding to the nozzles N of the first line L1 and the individual flow paths Q corresponding to the nozzles N of the second line L2 are arranged alternately in the Y-axis direction. As understood from the description above, the plurality of individual flow paths Q are in communication with both the first common liquid chamber K1 and the second common liquid chamber K2. In the ink that is supplied to the individual flow paths Q from the first common liquid chamber K1, the ink that is not ejected through the nozzles N is stored in the second common liquid chamber K2.

As illustrated as an example in FIG. 5, the liquid ejecting apparatus 100 includes a circulation mechanism 90. The circulation mechanism 90 is a mechanism that recirculates the ink, which is to be discharged from the liquid ejecting head 26, to the liquid ejecting head 26. The circulation mechanism 90 is a mechanism that circulates the ink that is supplied to the liquid ejecting head 26 and includes, for example, a supply flow path 91, a discharge flow path 92, and a circulation pump 93.

The supply flow path 91 is a flow path that supplies the ink to the first common liquid chamber K1 and is coupled to the introduction port 481 of the first common liquid chamber K1. The discharge flow path 92 is a flow path that discharges the ink from the second common liquid chamber K2 and is coupled to the discharge port 482 of the second common liquid chamber K2. The circulation pump 93 is a pumping mechanism that sends the ink supplied through the discharge flow path 92 to the supply flow path 91. In other words, the ink discharged from the second common liquid chamber K2 is recirculated to the first common liquid chamber K1 through the discharge flow path 92, the circulation pump 93, and the supply flow path 91. As understood from the description above, the circulation mechanism 90 functions as an element that collects the ink from the second common liquid chamber K2 and that recirculates the collected ink to the first common liquid chamber K1. Note that a configuration in which the circulation mechanism 90 collects the ink from the first common liquid chamber K1 and that recirculates the ink to the second common liquid chamber K2 may be adopted as well.

As illustrated as an example in FIG. 5, each individual flow path Q includes a pressure chamber C. As illustrated as an example in FIG. 2, the pressure chambers C are formed in the pressure chamber substrate 34. The pressure chamber substrate 34 is a plate-shaped member in which the plurality of pressure chambers C are each formed for a corresponding one of the plurality of nozzles N. Each pressure chamber C is a space elongated along the X-axis in plan view. As illustrated as an example in FIGS. 2 and 3, the plurality of pressure chambers C corresponding to the nozzles N of the first line L1 are arranged in the Y-axis direction and in a portion in the pressure chamber substrate 34 in the X-axis positive direction. As illustrated as an example in FIG. 4, the plurality of pressure chambers C corresponding to the nozzles N of the second line L2 are arranged in the Y-axis direction and in a portion in the pressure chamber substrate 34 in the X-axis negative direction. Each pressure chamber C overlaps the corresponding nozzle N in plan view.

Similar to the nozzle plate 62 described above, the flow path substrate 32 and the pressure chamber substrate 34 are manufactured by processing a single crystal substrate formed of silicon using a semiconductor manufacturing technique, for example. However, any known materials and any known manufacturing methods can be adopted to manufacture the flow path substrate 32 and the pressure chamber substrate 34.

As illustrated as an example in FIG. 2, the diaphragm 42 is formed on a surface of the pressure chamber substrate 34 on a side opposite the flow path substrate 32. The diaphragm 42 of the first embodiment is a plate-shaped member configured to vibrate elastically. Note that portions or the entire diaphragm 42 can be formed so as to be integrated with the pressure chamber substrate 34 by selectively removing portions of a plate-shaped member, having a predetermined plate thickness, corresponding to the pressure chambers C in the plate thickness direction. The pressure chambers C are spaces located between the flow path substrate 32 and the diaphragm 42.

As illustrated as an example in FIGS. 2 to 4, energy generating portions 44 are formed on a surface of the diaphragm 42 on a side opposite the pressure chambers C. The energy generating portions 44 are each formed for a corresponding nozzle N. The plurality of energy generating portions 44 are each formed for a corresponding one of the plurality of nozzles N. Each energy generating portion 44 generates energy for ejecting ink. Specifically, the energy generating portions 44 are each a drive element that ejects ink through the corresponding nozzle N by changing the pressure inside the corresponding pressure chamber C. In the first embodiment, piezoelectric elements are used as the energy generating portions 44. The piezoelectric elements each change the volume of the corresponding pressure chamber C by deforming the diaphragm 42. In other words, each energy generating portion 44 generates a pressure for ejecting ink. Specifically, each energy generating portion 44 is an actuator that becomes deformed by having a drive signal supplied thereto and is formed so as to be elongated along the X-axis in plan view. The plurality of energy generating portions 44 are arranged in the Y-axis direction so as to correspond to the plurality of pressure chambers C. When the diaphragm 42 working together with the deformation of the energy generating portions 44 is vibrated, the pressure inside each pressure chamber C is changed, which ejects the ink filled in each pressure chamber C through the corresponding nozzle N.

The protective substrate 46 in FIG. 2 is a plate-shaped member that, while protecting the plurality of energy generating portions 44, reinforces the mechanical strength of the diaphragm 42. Interposing the diaphragm 42 with the pressure chamber substrate 34, the protective substrate 46 is mounted on a side opposite the pressure chamber substrate 34. The plurality of energy generating portions 44 are mounted between the protective substrate 46 and the diaphragm 42. The protective substrate 46 is formed of silicon (Si), for example. As illustrated as an example in FIGS. 3 and 4, a wiring substrate 50, for example, is joined to a surface of the diaphragm 42. The wiring substrate 50 is a mounted component in which a plurality of wires that electrically couple the control unit 20 or a power supply circuit and the liquid ejecting head 26 to each other are formed. The flexible wiring substrate 50 such as, for example, a flexible printed circuit (FPC) or a flexible flat cable (FFC) is desirably used. A drive circuit 52 mounted on the wiring substrate 50 supplies a drive signal to each energy generating portion 44.

Figure 6:
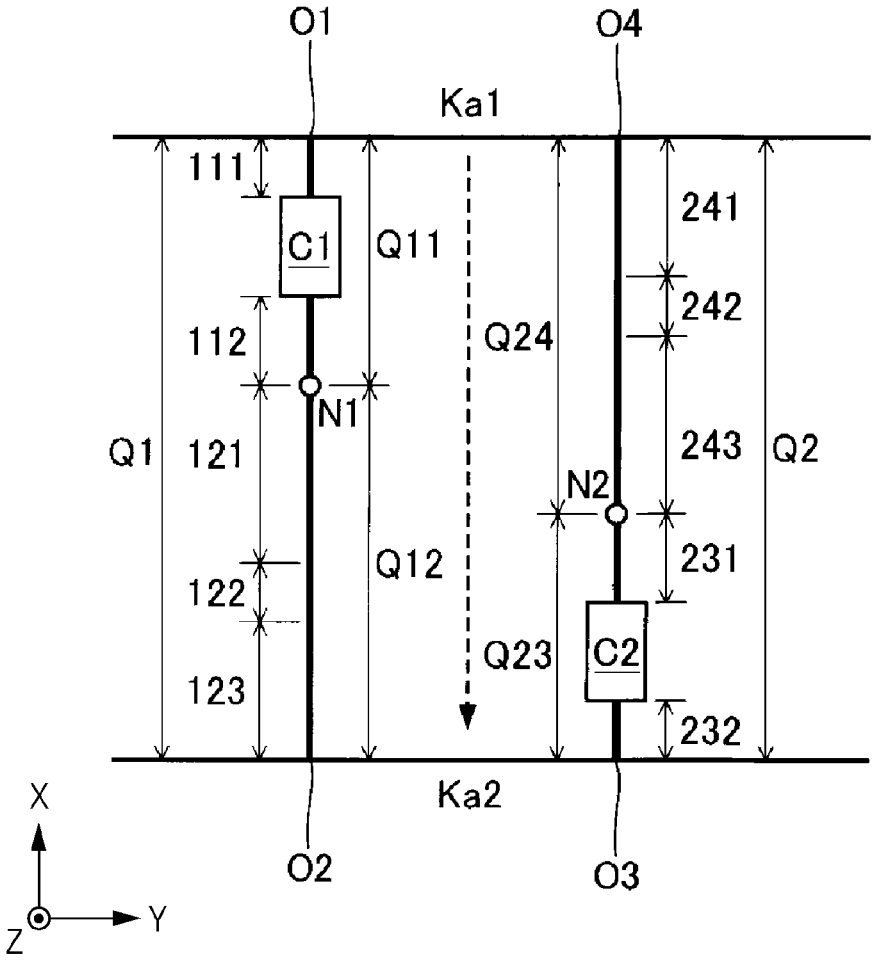
FIG. 6 is a schematic diagram of a first individual flow path and a second individual flow path.
Figure 7:
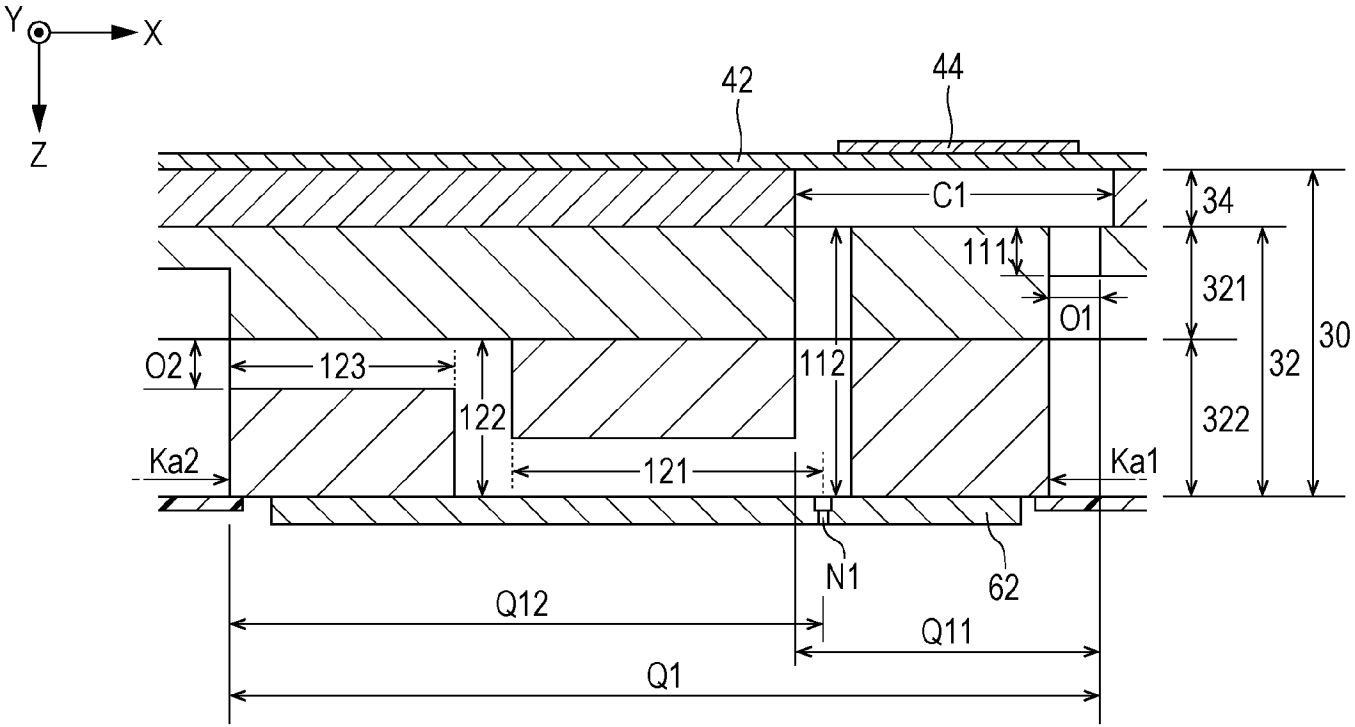
FIG. 7 is a cross-sectional view of the first individual flow path.
Figure 8:
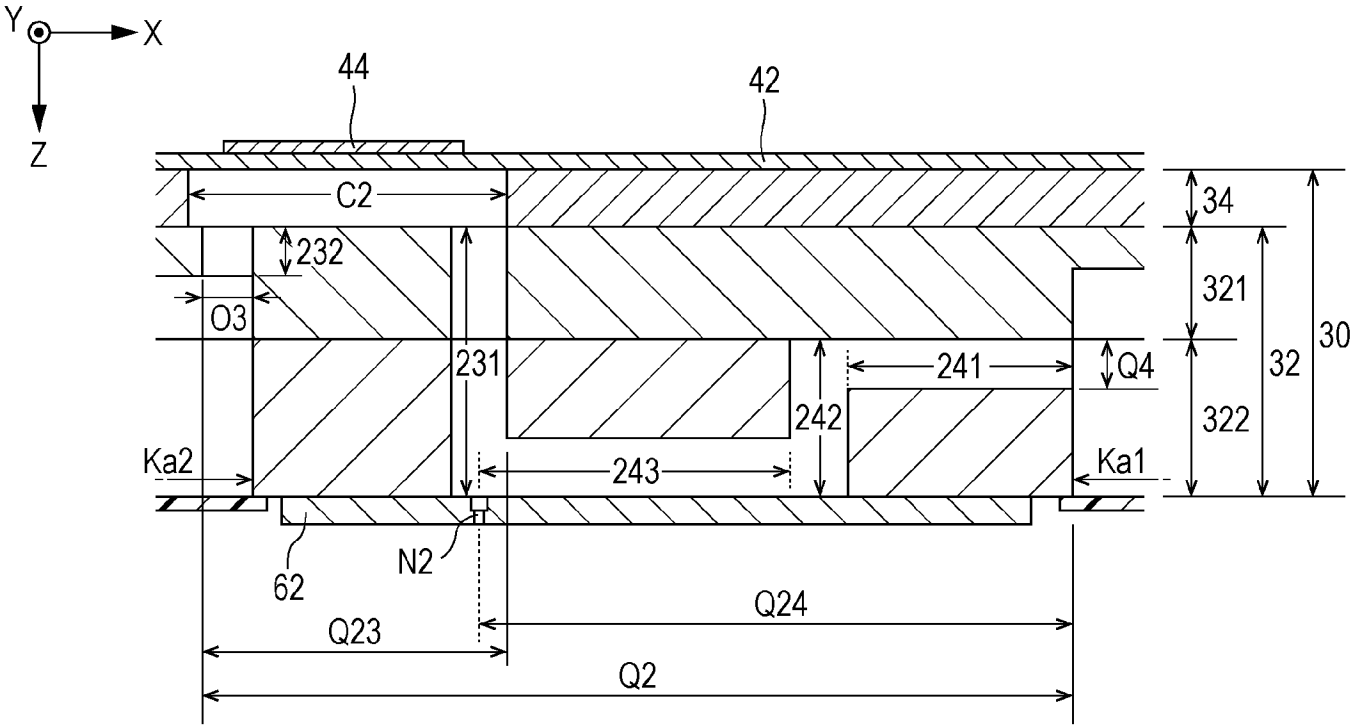
FIG. 8 is a cross-sectional view of the second individual flow path.

FIG. 6 is a schematic diagram focusing on, in the row of individual flow paths, two individual flow paths Q adjacent to each other in the Y-axis direction. Among the two individual flow paths Q, one is denoted as a "first individual flow path Q1" and the other is denoted as a "second individual flow path Q2". FIG. 7 is a cross-sectional view of the first individual flow path Q1 and FIG. 8 is a cross-sectional view of the second individual flow path Q2. FIG. 7 is an enlarged view of the individual flow path Q illustrated as an example in FIG. 3 and FIG. 8 is an enlarged view of the individual flow path Q illustrated as an example in FIG. 4. The first individual flow path Q1 is an individual flow path Q corresponding to any single nozzle N (hereinafter, referred to as a "first nozzle N1") in the first line L1, and the second individual flow path Q2 is an individual flow path Q corresponding to any single nozzle N (hereinafter, referred to as a "second nozzle N2") in the second line L2. The first nozzle N1 and the second nozzle N2 are, among the plurality of nozzles N formed in the nozzle plate 62, two nozzles N adjacent to each other when viewed in the X-axis direction. Furthermore, among the plurality of pressure chambers C, the pressure chamber C corresponding to the first individual flow path Q1 is denoted as a "first pressure chamber C1", and among the plurality of pressure chambers C, the pressure chamber C corresponding to the second individual flow path Q2 is denoted as a "second pressure chamber C2".

The first individual flow path Q1 and the second individual flow path Q2 are in an inverted relationship with respect to an XZ plane. As illustrated as an example in FIGS. 6 and 7, the first individual flow path Q1 includes a first communication flow path Q11 and a second communication flow path Q12.

The first communication flow path Q11 communicates the first common liquid chamber K1 and the first nozzle N1 with each other. Specifically, the first communication flow path Q11 is a flow path that extends from the opening O1 formed in the upper surface of the space Ka1 to an opening of the first nozzle N1 in the Z-axis negative direction. The first communication flow path Q11 of the first embodiment includes a first flow path 111, the first pressure chamber C1, and a second flow path 112. The first flow path 111 communicates the space Ka1 and the first pressure chamber C1 with each other. Specifically, the first flow path 111 is a through hole formed along the Z-axis in the first substrate 321. The first pressure chamber C1 communicates the first flow path 111 and the second flow path 112 with each other. As described above, the first pressure chamber C1 is a space that is elongated along the X-axis and that is formed in the pressure chamber substrate 34. The energy generating portion 44 corresponding to the first nozzle N1 is mounted on a surface of the diaphragm 42 on a side opposite the first pressure chamber C1. It can also be said that the energy generating portion 44 corresponding to the first nozzle N1 is provided midway of the first individual flow path Q1. Note that the energy generating portion 44 corresponding to the first nozzle N1 is an example of a "first energy generating portion". The second flow path 112 communicates the first pressure chamber C1 and the first nozzle N1 with each other. Specifically, the second flow path 112 is a through hole formed along the Z-axis and across the first substrate 321 and the second substrate 322.

The first pressure chamber C1 is in communication with the first common liquid chamber K1 through the first flow path 111 and is in communication with the first nozzle N1 through the second flow path 112. Accordingly, the ink filled in the first pressure chamber C1 from the first common liquid chamber K1 through the first flow path 111 passes through the second flow path 112 and is ejected through the first nozzle N1 with the deformation of the energy generating portion 44 corresponding to the first pressure chamber C1.

The second communication flow path Q12 communicates the second common liquid chamber K2 and the first nozzle N1 with each other. Specifically, the second communication flow path Q12 is a flow path that extends from a plane that includes a central axis of the first nozzle N1 and that is parallel to the YZ plane to the opening O2 formed in a lateral surface of the space Ka2. The second communication flow path Q12 of the first embodiment includes a third flow path 121, a fourth flow path 122, and a fifth flow path 123. The third flow path 121 communicates the first nozzle N1 and the fourth flow path 122 with each other. Specifically, the third flow path 121 is formed along the X-axis and in a surface of the second substrate 322 in the Z-axis positive direction. The fourth flow path 122 communicates the third flow path 121 and the fifth flow path 123 with each other. Specifically, the fourth flow path 122 is a through hole formed along the Z-axis in the second substrate 322. The fifth flow path 123 communicates the fourth flow path 122 and the second common liquid chamber K2 with each other. Specifically, the fifth flow path 123 is formed along the X-axis and in a surface of the second substrate 322 in the Z-axis negative direction. In the ink that is supplied to the first individual flow path Q1 from the first common liquid chamber K1, the ink that is not ejected through the first nozzle N1 is stored in the second common liquid chamber K2.

As illustrated as an example in FIGS. 6 and 8, the second individual flow path Q2 includes a third communication flow path Q23 and a fourth communication flow path Q24. The third communication flow path Q23 corresponds to the first communication flow path Q11, and the fourth communication flow path Q24 corresponds to the second communication flow path Q12. The first communication flow path Q11 and the fourth communication flow path Q24 are, in the X-axis positive direction, provided alternately along the Y-axis. The second communication flow path Q12 and the third communication flow path Q23 are, in the X-axis negative direction, provided alternately along the Y-axis.

The fourth communication flow path Q24 communicates the first common liquid chamber K1 and the second nozzle N2 with each other. Specifically, the fourth communication flow path Q24 is a flow path that extends from the opening O4 formed in a lateral surface of the space Ka1 to a plane that includes a central axis of the second nozzle N2 and that is parallel to the YZ plane. The fourth communication flow path Q24 of the first embodiment includes a sixth flow path 241, a seventh flow path 242, and an eighth flow path 243. The sixth flow path 241 couples the first common liquid chamber K1 and the seventh flow path 242 to each other. Specifically, the sixth flow path 241 is formed along the X-axis and in a surface of the second substrate 322 in the Z-axis negative direction. The seventh flow path 242 couples the sixth flow path 241 and the eighth flow path 243 to each other. Specifically, the seventh flow path 242 is a through hole formed along the Z-axis in the second substrate 322. The eighth flow path 243 communicates the seventh flow path 242 and the second nozzle N2 with each other. Specifically, the eighth flow path 243 is formed along the X-axis and in a surface of the second substrate 322 in the Z-axis positive direction.

The third communication flow path Q23 is a flow path that communicates the second common liquid chamber K2 and the second nozzle N2 with each other. Specifically, the third communication flow path Q23 is a flow path that extends from an opening of the second nozzle N2 in the Z-axis negative direction to the opening O3 formed in an upper surface of the space Ka2. The third communication flow path Q23 of the first embodiment includes a ninth flow path 231, the second pressure chamber C2, and a tenth flow path 232. The ninth flow path 231 couples the second nozzle N2 and the second pressure chamber C2 to each other. Specifically, the ninth flow path 231 is a through hole formed along the Z-axis and across the first substrate 321 and the second substrate 322. The second pressure chamber C2 communicates the ninth flow path 231 and the tenth flow path 232 with each other. As described above, the second pressure chamber C2 is a space that is elongated along the X-axis and that is formed in the pressure chamber substrate 34. The energy generating portion 44 corresponding to the second nozzle N2 is mounted on a surface of the diaphragm 42 on a side opposite the second pressure chamber C2. It can also be said that the energy generating portion 44 corresponding to the second nozzle N2 is provided midway of the second individual flow path Q2. Note that the energy generating portion 44 corresponding to the second nozzle N2 is an example of a "second energy generating portion". The tenth flow path 232 communicates the second pressure chamber C2 and the space Ka2 with each other. Specifically, the tenth flow path 232 is a through hole formed along the Z-axis in the first substrate 321.

The ink is filled into the second pressure chamber C2 from the first common liquid chamber K1 through the fourth communication flow path Q24 and the ninth flow path 231. The ink inside the second pressure chamber C2 is ejected through the second nozzle N2 via the ninth flow path 231 with the deformation of the energy generating portion 44. In the ink that is supplied to the second individual flow path Q2 from the first common liquid chamber K1, the ink that is not ejected through the second nozzle N2 is stored in the second common liquid chamber K2.

A flow path resistance R of the first individual flow path Q1 and a flow path resistance R of the second individual flow path Q2 are the same. A flow path resistance R is a total value of a flow path resistance R of the first communication flow path Q11 and a flow path resistance R of the second communication flow path Q12. A flow path resistance R of the second individual flow path Q2 is a total value of a flow path resistance R of the third communication flow path Q23 and a flow path resistance R of the fourth communication flow path Q24. The flow path resistance R is, for example, calculated with the Expression (1) below, where μ is a viscosity of the ink, L is a flow path length, and d is a flow path diameter. Note that except for when the cross-sectional shape of the flow path is a perfect circle, the flow path diameter d is a diameter of a circle in which the area is the same as the cross-sectional area of the flow path. Note that regarding a flow path resistance R of a flow path that is configured of a plurality of sections that have different flow path diameters, the total value of the flow path resistance R of each section is the flow path resistance R of the flow path.

$$R=128\ \mu L/\pi d^4 \tag{1}$$

As it can be understood from Expression (1), the flow path resistance R can be set by adjusting the flow path length L and the flow path diameter d. By equalizing the flow path resistance R of the first individual flow path Q1 and the flow path resistance R of the second individual flow path Q2, occurrence of errors in the ejection characteristics between the first nozzle N1 and the second nozzle N2 can be reduced. The ejection characteristics are, for example, the ejecting amount, the ejecting direction, and the ejecting speed.

In the first embodiment, the flow path resistance R of the first communication flow path Q11 and the flow path resistance R of the fourth communication flow path Q24 are the same. Accordingly, an error between a pressure loss occurring in the flow of the ink from the first common liquid chamber K1, via the first communication flow path Q11, to the first nozzle N1 and a pressure loss occurring in the flow of the ink from the first common liquid chamber K1, via the fourth communication flow path Q24, to the second nozzle N2 can be reduced. In other words, an error in the ejection characteristics between the first nozzle N1 and the second nozzle N2 can be reduced. Note that the flow path resistance R of the first communication flow path Q11 is a total value of a flow path resistance R of the first flow path 111, a flow path resistance R of the first pressure chamber C1, and a flow path resistance R of the second flow path 112. Furthermore, the flow path resistance R of the fourth communication flow path Q24 is a total value of a flow path resistance R of the sixth flow path 241, a flow path resistance R of the seventh flow path 242, and a flow path resistance R of the eighth flow path 243.

The flow path resistance R of the second communication flow path Q12 and the flow path resistance R of the third communication flow path Q23 are the same. Accordingly, an error between a pressure loss occurring in the flow of the ink from the first nozzle N1, via the second communication flow path Q12, to the second common liquid chamber K2 and a pressure loss occurring in the flow of the ink from the second nozzle N2, via the third communication flow path Q23, to the second common liquid chamber K2 can be reduced. In other words, an error in the ejection characteristics between the first nozzle N1 and the second nozzle N2 can be reduced. Note that the flow path resistance R of the second communication flow path Q12 is a total value of a flow path resistance R of the third flow path 121, a flow path resistance R of the fourth flow path 122, and a flow path resistance R of the fifth flow path 123. Furthermore, the flow path resistance R of the third communication flow path Q23 is a total value of a flow path resistance R of the ninth flow path 231, a flow path resistance R of the second pressure chamber C2, and a flow path resistance R of the tenth flow path 232.

In actuality, the ink can be supplied to the first nozzle N1 from the second common liquid chamber K2 as well. Accordingly, in the first embodiment, the flow path resistance R of the first communication flow path Q11 and the flow path resistance R of the second communication flow path Q12 are equalized. In other words, in the first individual flow path Q1, when viewed from the first nozzle N1, the flow path resistance R of the first common liquid chamber K1 side and that of the second common liquid chamber K2 side are the same. Accordingly, occurrence of errors in the ejection characteristics of the first nozzle N1 between when the ink is supplied to the first nozzle N1 from the first common liquid chamber K1 and when the ink is supplied to the first nozzle N1 from the second common liquid chamber K2 can be reduced.

Similarly, there are cases in which the ink is supplied to the second nozzle N2 from the second common liquid chamber K2 as well. Accordingly, the flow path resistance R of the third communication flow path Q23 and the flow path resistance R of the fourth communication flow path Q24 are equalized. In other words, in the second individual flow path Q2, when viewed from the second nozzle N2, the flow path resistance R of the first common liquid chamber K1 side and that of the second common liquid chamber K2 side are the same. Accordingly, occurrence of errors in the ejection characteristics of the second nozzle N2 between when the ink is supplied to the second nozzle N2 from the first common liquid chamber K1 and when the ink is supplied to the second nozzle N2 from the second common liquid chamber K2 can be reduced.

Note that "a flow path resistance Ra of a flow path A and a flow path resistance Rb of a flow path B are the same" includes, other than a case in which the flow path resistance Ra and the flow path resistance Rb are strictly the same, a case in which the flow path resistance Ra and the flow path resistance Rb are practically the same. For example, "the flow path resistance Ra and the flow path resistance Rb are practically the same" is when the flow path resistance Ra and the flow path resistance Rb are, with respect to each other, within the range of the manufacturing error. For example, when the flow path resistance Ra and the flow path resistance Rb satisfy the following Expression (2), it can be said that "the flow path resistance Ra and the flow path resistance Rb are practically the same".

$$0.45 \leq Ra/(Ra+Rb) \leq 0.55 \quad (2)$$

As understood from Expression (2), for example, "the flow path resistance R of the first communication flow path Q11 and the flow path resistance R of the second communication flow path Q12 are practically the same" means that, with respect to half the value of the flow path resistance R of the entire first individual flow path Q1, the first communication flow path Q11 and the second communication flow path Q12 are formed, with the first nozzle N1 as the reference, so that the deviation in the flow path resistances R is within ±5%. In the above, while a focus has been given on the relationship between the flow path resistances R of the first communication flow path Q11 and the second communication flow path Q12, the relationships between the flow path resistances R of the other flow paths are similar to the above relationship.

In addition to the condition of the flow path resistances described above, in the first embodiment, an inertance M of the first communication flow path Q11 in the first individual flow path Q1 is set smaller than an inertance M of the second communication flow path Q12 in the first individual flow path Q1. The inertance M is calculated with Expression (3) below, where ρ is density of the ink, L is the flow path length, and S is a flow-path sectional area. Note that regarding an inertance M of a flow path configured of a plurality of sections having different cross-sectional areas, the inertance M of the flow path is the total amount of the inertances M of the sections.

$$M = \rho L/S \quad (3)$$

As it can be understood from Expression (3), the inertance M can be set by adjusting the flow path length L and the flow-path sectional area S. Pressure oscillation generated in the first pressure chamber C1 with the energy generating portion 44 creates a flow of the ink in the first communication flow path Q11 towards the first nozzle N1. A portion of the ink in the first communication flow path Q11 flowing towards the first nozzle N1 is ejected through the first nozzle N1, and the remaining ink is discharged to the second common liquid chamber K2 through the second communication flow path Q12. From the viewpoint of improving the ejection efficiency, a configuration in which the amount of ink discharged through the second communication flow path Q12 is set relatively small and in which the amount of ink ejected through the first nozzle N1 is set relatively large is desirable. In order to adopt such a configuration, a design in which the inertance M of the second communication flow path Q12 is large is effective. Accordingly, in the first embodiment, the inertance M of the second communication flow path Q12 is set larger than the inertance M of the first communication flow path Q11. In other words, a design in which the inertance M of the first communication flow path Q11 is smaller than the inertance M of the second communication flow path Q12 is adopted.

As it can be understood from Expression (3), the inertance M can be adjusted with the flow path length L. Specifically, the flow path length L and the inertance M are in a proportional relation. Accordingly, the inertance M of the first communication flow path Q11 is set smaller than the inertance M of the second communication flow path Q12 by having a flow path length L of the first communication flow path Q11 be shorter than a flow path length L of the second communication flow path Q12. The flow path length L of the first communication flow path Q11 is, for example, a distance along a center line of the first communication flow path Q11 from an end point of the first communication flow path Q11 on the first common liquid chamber K1 side to an end point of the first communication flow path Q11 on the first nozzle N1 side. The end point of the first communication flow path Q11 on the first common liquid chamber K1 side is an intersection between the opening O1 and the center line of the first communication flow path Q11. On the other hand, the end point of the first communication flow path Q11 on the first nozzle N1 side is an intersection between the center line of the first communication flow path Q11 and an opening of the first nozzle N1 in the Z-axis negative direction. The flow path length L of the second communication flow path Q12 is, for example, a distance along a center line of the second communication flow path Q12 from an end point of the second communication flow path Q12 on the first nozzle N1 side to an end point of the second communication flow path Q12 on the second common liquid chamber K2 side. The end point of the second communication flow path Q12 on the first nozzle N1 side is an intersection between the center line of the second communication flow path Q12 and a plane that includes the central axis of the first nozzle N1 and that is parallel to the YZ plane. On the other hand, the end point of the second communication flow path Q12 on the second common liquid chamber K2 side is an intersection between the opening O2 and the center line of the second communication flow path Q12.

For example, in a configuration in which the inertance M of the first communication flow path Q11 and the inertance M of the second communication flow path Q12 are adjusted by differing the flow path diameter d of the first communication flow path Q11 and the flow path diameter d of the second communication flow path Q12, as it can be understood from Expression (1), the effect on the flow path resistance R is large. Conversely, in the configuration of the first embodiment in which the flow path length L of the first communication flow path Q11 and the flow path length L of the second communication flow path Q12 are differed, the inertance M of the first communication flow path Q11 can be set smaller than the inertance M of the second communication flow path Q12 while suppressing the effect on the flow path resistance R. However, a configuration in which the flow path diameter d of the first communication flow path Q11 and the flow path diameter d of the second communication flow path Q12 are differed can be adopted as well.

In the first embodiment, a minimum diameter of the first communication flow path Q11 is smaller than a minimum diameter of the second communication flow path Q12. The minimum diameter is the smallest value of the flow path diameter. The minimum diameter of the first communication flow path Q11 is, for example, a flow path diameter of the first flow path 111. The minimum diameter of the second communication flow path Q12 is, for example, a flow path diameter of the fifth flow path 123. Note that it can also be said that a minimum flow-path sectional area of the first communication flow path Q11 is smaller than a minimum flow-path sectional area of the second communication flow path Q12. In a flow path that has been relatively narrowed as in the fifth flow path 123, compared with the addition of the inertance M, a larger resistance is added to the flow path. In other words, when a narrowed flow path is provided, only a small amount of additional inertance M can be generated with respect to the added amount of the resistance. Accordingly, when under a condition in which the resistance of the first communication flow path Q11 is set similar to the resistance of the second communication flow path Q12, when a flow path that is, compared with the first communication flow path Q11, narrowed is provided on the second communication flow path Q12 side, the inertance M of the second communication flow path Q12 becomes relatively small, which causes the ejection efficiency to decrease. Accordingly, in the first embodiment, the minimum diameter of the second communication flow path Q12 is set larger than the minimum diameter of the first communication flow path Q11. In other words, the minimum diameter of the first communication flow path Q11 is set smaller than the minimum diameter of the second communication flow path Q12. However, a configuration in which the minimum diameter of the first communication flow path Q11 is larger than the minimum diameter of the second communication flow path Q12 can be adopted as well.

Pressure oscillation generated in the second pressure chamber C2 with the energy generating portion 44 creates a flow of the ink in the third communication flow path Q23 towards the second nozzle N2. A portion of the ink in the third communication flow path Q23 flowing towards the second nozzle N2 is ejected through the second nozzle N2, and the remaining ink flows to the fourth communication flow path Q24 side. From the viewpoint of improving the ejection efficiency, a configuration in which the amount of ink flowing to the fourth communication flow path Q24 side is set relatively small and in which the amount of ink ejected through the second nozzle N2 is set relatively large is desirable. In order to adopt such a configuration, a design in which the inertance M of the fourth communication flow path Q24 is large is effective. Accordingly, in the first embodiment, the inertance M of the fourth communication flow path Q24 is set larger than the inertance M of the third communication flow path Q23. In other words, a design in which the inertance M of the third communication flow path Q23 is smaller than the inertance M of the fourth communication flow path Q24 is adopted.

Specifically, the inertance M of the third communication flow path Q23 is set smaller than the inertance M of the fourth communication flow path Q24 by having a flow path length L of the third communication flow path Q23 be shorter than a flow path length L of the fourth communication flow path Q24. The flow path length L of the third communication flow path Q23 is, for example, a distance along a center line of the third communication flow path Q23 from an end point of the third communication flow path Q23 on the second nozzle N2 side to an end point of the third communication flow path Q23 on the second common liquid chamber K2 side. The end point of the third communication flow path Q23 on the second nozzle N2 side is an intersection between the center line of the third communication flow path Q23 and an opening of the second nozzle N2 in the Z-axis negative direction. On the other hand, the end point of the third communication flow path Q23 on the second common liquid chamber K2 side is an intersection between the opening O3 and the center line of the third communication flow path Q23. The flow path length L of the fourth communication flow path Q24 is, for example, a distance along a center line of the fourth communication flow path Q24 from an end point of the fourth communication flow path Q24 on the first common liquid chamber K1 side to an end point of the fourth communication flow path Q24 on the second nozzle N2 side. The end point of the fourth communication flow path Q24 on the first common liquid chamber K1 side is an intersection between the opening O4 and the center line of the fourth communication flow path Q24. On the other hand, the end point of the fourth communication flow path Q24 on the second nozzle N2 side is an intersection between the center line of the fourth communication flow path Q24 and a plane that includes the central axis of the second nozzle N2 and that is parallel to the YZ plane.

For example, in a configuration in which the inertance M of the third communication flow path Q23 and the inertance M of the fourth communication flow path Q24 are adjusted by differing the flow path diameter d of the third communication flow path Q23 and the flow path diameter d of the fourth communication flow path Q24, as described above, the effect on the flow path resistance R is large. Conversely, in the configuration of the first embodiment in which the flow path length L of the third communication flow path Q23 and the flow path length L of the fourth communication flow path Q24 are differed, the inertance M of the third communication flow path Q23 can be set smaller than the inertance M of the fourth communication flow path Q24 while suppressing the effect on the flow path resistance R. However, a configuration in which the flow path diameter d of the third communication flow path Q23 and the flow path diameter d of the fourth communication flow path Q24 are differed can be adopted as well.

A minimum diameter of the third communication flow path Q23 is smaller than a minimum diameter of the fourth communication flow path Q24. The minimum diameter of the third communication flow path Q23 is, for example, a flow path diameter of the tenth flow path 232. The minimum diameter of the fourth communication flow path Q24 is, for example, a minimum diameter of the sixth flow path 241. Note that it can also be said that a minimum flow-path sectional area of the third communication flow path Q23 is smaller than a minimum flow-path sectional area of the fourth communication flow path Q24. In a flow path that has been relatively narrowed as in the sixth flow path 241, compared with the addition of the inertance M, a larger resistance is added to the flow path. In other words, when a narrowed flow path is provided, only a small amount of additional inertance M can be generated with respect to the added amount of the resistance. Accordingly, when under a condition in which the resistance of the third communication flow path Q23 is set similar to the resistance of the fourth communication flow path Q24, when a flow path that is, compared with the third communication flow path Q23, narrowed is provided on the fourth communication flow path Q24 side, the inertance M of the fourth communication flow path Q24 becomes relatively small, which causes the ejection efficiency to decrease. Accordingly, in the first embodiment, the minimum diameter of the fourth communication flow path Q24 is set larger than the minimum diameter of the third communication flow path Q23. In other words, the minimum diameter of the third communication flow path Q23 is set smaller than the minimum diameter of the fourth communication flow path Q24. However, a configuration in which the minimum diameter of the third communication flow path Q23 is larger than the minimum diameter of the fourth communication flow path Q24 can be adopted as well.

Herein, a configuration (hereinafter, referred to as a "comparative example") in which the row of individual flow paths is formed with only the first individual flow paths Q1 is assumed. In the comparative example, a plurality of first communication flow paths Q11 are arranged in the flow path structure 30 in the X-axis positive direction, and a plurality of second communication flow paths Q12 that each have an inertance M that is larger than that of the first communication flow path Q11 are arranged in the flow path structure 30 in the X-axis negative direction. In other words, large inertances M and small inertances M are unevenly distributed in the flow path structure 30. As described above, the inertance M depends on the flow path length or the flow path diameter. Accordingly, in the comparative example, the flow paths cannot be disposed efficiently. In other words, there will be wasted spaces in the flow path structure 30.

Conversely, in the first embodiment, in the X-axis positive direction of the flow path structure 30, the first communication flow path Q11, and the fourth communication flow path Q24 that has the inertance M that is larger than that of the first communication flow path Q11 are positioned alternately in the Y-axis direction. Similarly, in the X-axis negative direction of the flow path structure 30, the third communication flow path Q23, and the second communication flow path Q12 that has the inertance M that is larger than that of the third communication flow path Q23 are positioned alternately in the Y-axis direction. In other words, large inertances M and small inertances M are evenly distributed in the flow path structure 30. Accordingly, wasted portions in the flow path structure 30 can be reduced and the flow paths can be disposed efficiently. As understood from the above description, in the first embodiment, arranging of the flow paths in an efficient manner and improvement of the ejection efficiency of the plurality of nozzles N can both be achieved.

Second Embodiment

A second embodiment of the present disclosure will be described. Note that in the following examples, elements having functions similar to those of the first embodiment will be denoted with the reference numerals used in the description of the first embodiment, and detailed description of the elements will be omitted appropriately.

Figure 9:
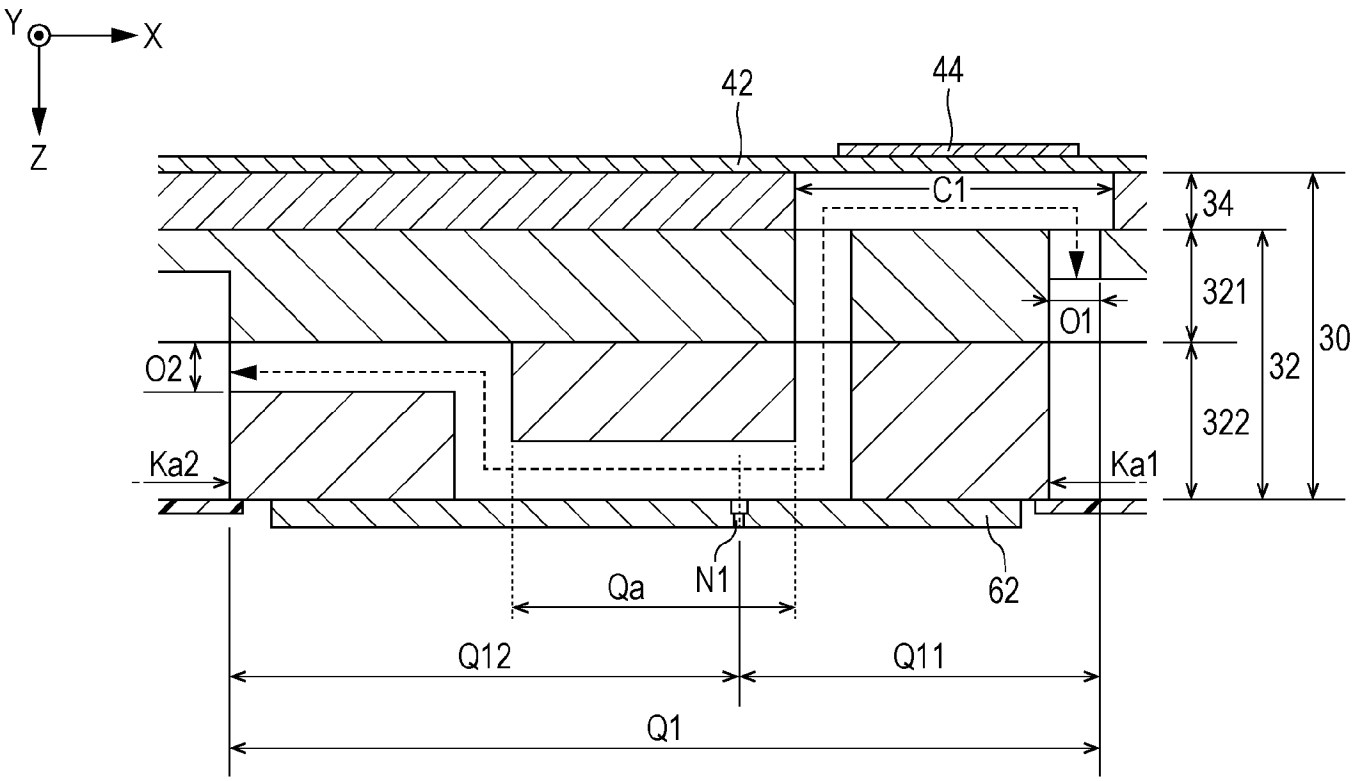
FIG. 9 is a cross-sectional view of a first individual flow path according to a second embodiment.
Figure 10:
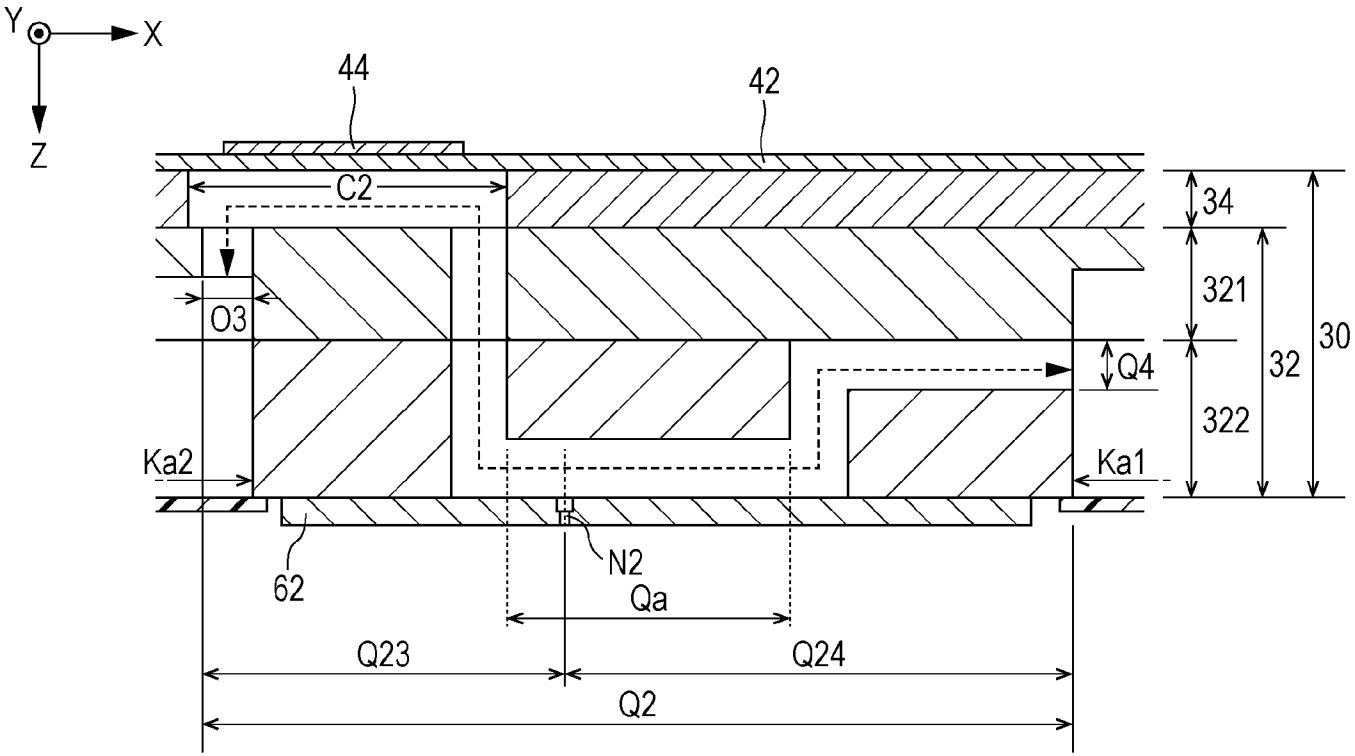
FIG. 10 is a cross-sectional view of a second individual flow path according to a second embodiment.

FIG. 9 is a cross-sectional view of the first individual flow path Q1 according to the second embodiment, and FIG. 10 is a cross-sectional view of the second individual flow path Q2 according to the second embodiment. The structures of the first individual flow path Q1 and the second individual flow path Q2 of the second embodiment are similar to those of the first embodiment. However, in the second embodiment, the positions of the first nozzles N1 and the second nozzles N2 are different from those of the first embodiment. Note that in the second embodiment as well, the first individual flow path Q1 and the second individual flow path Q2 are in an inverted relationship with respect to the YZ plane. Furthermore, the flow path resistances R of the flow paths are similar to those of the first embodiment.

As illustrated in FIGS. 9 and 10, the first individual flow path Q1 and the second individual flow path Q2 include a flow path (hereinafter, referred to as a "local flow path") Qa that extends in the X-axis direction. The local flow path Qa is formed in a surface of the second substrate 322 in the Z-axis positive direction. The first nozzle N1 and the second nozzle N2 are each formed in an area (hereinafter, referred to as a "local area") in the nozzle plate 62 corresponding to the local flow path Qa. It can also be said the local area constitutes a bottom surface of the local flow path Qa. In other words, each of the first nozzle N1 and the second nozzle N2 is formed so as to branch off from the corresponding local flow path Qa. As illustrated as an example in FIG. 9, the first nozzle N1 is, in cross-sectional view, formed in an area of the local area in the X-axis positive direction, for example. As illustrated as an example in FIG. 10, the second nozzle N2 is, in cross-sectional view, formed in an area of the local area in the X-axis negative direction, for example.

As illustrated as an example in FIG. 9, similar to the first embodiment, the first communication flow path Q11 communicates the first common liquid chamber K1 and the first nozzle N1 with each other. The first communication flow path Q11 of the second embodiment is a flow path that extends from the opening O1 formed in the upper surface of the space Ka1 to a plane that includes the central axis of the first nozzle N1 and that is parallel to the YZ plane. Similar to the first embodiment, the flow path length L of the first communication flow path Q11 is a distance along the center line of the first communication flow path Q11 from the end point of the communication flow path Q11 on the first common liquid chamber K1 side to an end point of the first communication flow path Q11 on the first nozzle N1 side. Similar to the first embodiment, the end point of the first communication flow path Q11 on the first common liquid chamber K1 side is the intersection between the center line of the first communication flow path Q11 and the opening O1. On the other hand, the end point of the first communication flow path Q11 on the first nozzle N1 side is an intersection between the center line of the first communication flow path Q11 and the plane that includes the central axis of the first nozzle N1 and that is parallel to the YZ plane.

Similar to the first embodiment, the second communication flow path Q12 communicates the second common liquid chamber K2 and the first nozzle N1 with each other. The second communication flow path Q12 of the second embodiment is a flow path that extends from the plane that includes the central axis of the first nozzle N1 and that is parallel to the YZ plane to the opening O2 formed in the lateral surface of the space Ka2. The flow path length of the second communication flow path Q12 is, similar to the first embodiment, a distance along the center line of the second communication flow path Q12 from an end point of the second communication flow path Q12 on the first nozzle N1 side to the end point of the second communication flow path Q12 on the second common liquid chamber K2 side. The end point of the second communication flow path Q12 on the first nozzle N1 side is an intersection between the center line of the second communication flow path Q12 and the plane that includes the central axis of the first nozzle N1 and that is parallel to the YZ plane. On the other hand, the end point of the second communication flow path Q12 on the second common liquid chamber K2 side is, similar to the first embodiment, the intersection between the opening O2 and the center line of the second communication flow path Q12. In the second embodiment as well, similar to the first embodiment, the inertance M of the first communication flow path Q11 is smaller than the inertance M of the second communication flow path Q12, and the flow path length of the first communication flow path Q11 is shorter than the flow path length of the second communication flow path Q12.

As illustrated as an example in FIG. 10, similar to the first embodiment, the fourth communication flow path Q24 communicates the first common liquid chamber K1 and the second nozzle N2 with each other. The fourth communication flow path Q24 of the second embodiment is a flow path that extends from the opening O4 formed in the space Ka1 to a plane that includes a central axis of the second nozzle N2 and that is parallel to the YZ plane. Similar to the first embodiment, the flow path length L of the fourth communication flow path Q24 is a distance along the center line of the fourth communication flow path Q24 from the end point of the fourth communication flow path Q24 on the first common liquid chamber K1 side to an end point of the fourth communication flow path Q24 on the second nozzle N2 side. The end point of the fourth communication flow path Q24 on the first common liquid chamber K1 side is, similar to the first embodiment, the intersection between the opening O4 and the center line of the fourth communication flow path Q24. On the other hand, the end point of the fourth communication flow path Q24 on the second nozzle N2 side is an intersection between the center line of the fourth communication flow path Q24 and a plane that includes the central axis of the second nozzle N2 and that is parallel to the YZ plane.

Similar to the first embodiment, the third communication flow path Q23 communicates the second common liquid chamber K2 and the second nozzle N2 with each other. The third communication flow path Q23 of the second embodiment is a flow path that extends from the plane that includes the central axis of the second nozzle N2 and that is parallel to the YZ plane to the opening O3 formed in the upper surface of the space Ka2. Similar to the first embodiment, the flow path length L of the third communication flow path Q23 is a distance along the center line of the third communication flow path Q23 from the end point of the third communication flow path Q23 on the second nozzle N2 side to an end point of the third communication flow path Q23 on the second common liquid chamber K2 side. The end point of the third communication flow path Q23 on the second nozzle N2 side is an intersection between the center line of the third communication flow path Q23 and the plane that includes the central axis of the second nozzle N2 and that is parallel to the YZ plane. On the other hand, the end point of the third communication flow path Q23 on the second common liquid chamber K2 side is, similar to the first embodiment, the intersection between the opening O3 and the center line of the third communication flow path Q23. In the second embodiment as well, similar to the first embodiment, the inertance M of the third communication flow path Q23 is smaller than the inertance M of the fourth communication flow path Q24, and the flow path length of the third communication flow path Q23 is shorter than the flow path length of the fourth communication flow path Q24.

An effect similar to the first embodiment can be provided in the second embodiment as well. As understood from the above description, the positions of the first nozzle N1 and the second nozzle N2 are optional in a configuration in which the inertance M of the first communication flow path Q11 is smaller than the inertance M of the second communication flow path Q12 and in which the inertance M of the third communication flow path Q23 is smaller than the inertance M of the fourth communication flow path Q24. For example, the position of the first nozzle N1 in the X-axis direction and the position of the second nozzle N2 in the X-axis direction may be the same.

Modifications

Each of the embodiments described above as examples can be modified in various ways. Specific modification modes that can be applied to the configurations described above will be described below as examples. Two or more optionally selected modes from the examples below can be merged as appropriate as long as they do not contradict each other.

(1) The shapes of the individual flow paths Q are not limited to those illustrated as examples in the configurations described above. For example, in addition to the first flow path 111, the first pressure chamber C1, and the second flow path 112, the first communication flow path Q11 may include another flow path. The same applies to the second communication flow path Q12, the third communication flow path Q23, and the fourth communication flow path Q24. Furthermore, the shapes of the first individual flow path Q1 and the second individual flow path Q2 may be different, or the shapes of the first individual flow path Q1 and the second individual flow path Q2 may be the same.

(2) In the configurations described above, the flow path substrate 32 is formed of layers including the first substrate 321 and the second substrate 322; however, the configuration of the flow path substrate 32 is not limited to the example described above. For example, the flow path substrate 32 may be formed of a single layer, or the flow path substrate 32 may be formed of at least three layers.

(3) In the configurations described above, a configuration in which the flow path resistance R of the first communication flow path Q11 and the flow path resistance R of the fourth communication flow path Q24 are the same has been described as an example; however, the flow path resistance R of the first communication flow path Q11 and the flow path resistance R of the fourth communication flow path Q24 may be different. Similarly, the flow path resistance R of the second communication flow path Q12 and the flow path resistance R of the third communication flow path Q23 may be different. Furthermore, the flow path resistance R of the first communication flow path Q11 and the flow path resistance R of the second communication flow path Q12 may be different, and the flow path resistance R of the third communication flow path Q23 and the flow path resistance R of the fourth communication flow path Q24 may be different.

(4) In the configurations described above, the flow path diameter of the first flow path 111 is the minimum diameter of the first communication flow path Q11; however, the minimum diameter of the first flow path 111 may be a flow path diameter of a flow path other than the first flow path 111. In a similar manner, the minimum diameter of each of the second communication flow path Q12, the third communication flow path Q23, and the fourth communication flow path Q24 may be a flow path diameter of any flow path in the corresponding communication flow path.

(5) The energy generating portions 44 that generate energy to eject the liquid inside the pressure chambers C through the nozzles N are not limited to the piezoelectric elements. For example, heating elements that generate air bubbles inside the pressure chambers C through heating to change the pressure inside the pressure chambers C may be used as the energy generating portions 44. As it can be understood from the examples described above, the energy generating portions 44 are expressed comprehensively as elements that eject the liquid in the pressure chambers C through the nozzles N, and the operation system such as a piezoelectric system or a thermal system, and the specific configuration of the energy generating portions 44 do not need to be stated in particular. In other words, the energy to eject the liquid includes both heat and pressure.

(6) While in the configurations described above, the serial type liquid ejecting apparatus 100 in which the transport body 82 in which the liquid ejecting head 26 is mounted is reciprocated has been described as an example, a line type liquid ejecting apparatus in which a plurality of nozzles N are distributed across the entire width of the medium 12 can also be applied to the present disclosure.

(7) The liquid ejecting apparatus 100 described as an example in the configurations described above may be employed in various apparatuses other than an apparatus dedicated to printing, such as a facsimile machine and a copier. Note that the application of the liquid ejecting apparatus of the present disclosure is not limited to printing. For example, a liquid ejecting apparatus that ejects a coloring material solution is used as a manufacturing apparatus that forms a color filter of a display device such as a liquid crystal display panel. Furthermore, a liquid ejecting apparatus that ejects a conductive material solution is used as a manufacturing apparatus that forms wiring and electrodes of a wiring substrate. Furthermore, a liquid ejecting apparatus that ejects a solution of an organic matter related to a living body is used, for example, as a manufacturing apparatus that manufactures a biochip.

What is claimed is:

1. A liquid ejecting head comprising:

a plurality of nozzles that eject a liquid along a first axis;

a row of individual flow paths that includes a plurality of individual flow paths arranged in parallel along a second axis orthogonal to the first axis when viewed in a direction of the first axis, the row of individual flow paths each being provided to a corresponding one of the plurality of nozzles;

a plurality of energy generating portions that generate energy to eject the liquid, the plurality of energy generating portions each being provided to a corresponding one of the plurality of nozzles;

a first common liquid chamber that is commonly in communication with the plurality of individual flow paths; and a second common liquid chamber that is commonly in communication with the plurality of individual flow paths, wherein the plurality of individual flow paths include a first individual flow path and a second individual flow path that are adjacent to each other in the row of individual flow paths, in the first individual flow path, a first energy generating portion in the plurality of energy generating portions is provided midway of a first communication flow path that communicates the first common liquid chamber and a first nozzle in the plurality of nozzles with each other, and an inertance of the first communication flow path is smaller than an inertance of a second communication flow path that communicates the second common liquid chamber and the first nozzle with each other, and in the second individual flow path, a second energy generating portion in the plurality of energy generating portions is provided midway of a third communication flow path that communicates the second common liquid chamber and a second nozzle in the plurality of nozzles with each other, and an inertance of the third communication flow path is smaller than an inertance of a fourth communication flow path that communicates the first common liquid chamber and the second nozzle with each other.

2. The liquid ejecting head according to claim 1, wherein a flow path resistance of the first communication flow path and a flow path resistance of the fourth communication flow path are equivalent to each other.

3. The liquid ejecting head according to claim 2, wherein a flow path resistance of the second communication flow path and a flow path resistance of the third communication flow path are equivalent to each other.

4. The liquid ejecting head according to claim 1, wherein a flow path resistance of the first communication flow path and a flow path resistance of the second communication flow path are equivalent to each other.

5. The liquid ejecting head according to claim 4, wherein a flow path resistance of the third communication flow path and a flow path resistance of the fourth communication flow path are equivalent to each other.

6. The liquid ejecting head according to claim 1, wherein a minimum diameter of the first communication flow path is smaller than a minimum diameter of the second communication flow path.

7. The liquid ejecting head according to claim 6, wherein a minimum diameter of the third communication flow path is smaller than a minimum diameter of the fourth communication flow path.

8. The liquid ejecting head according to claim 1, wherein each of the plurality of individual flow paths includes a local flow path that extends in a direction of a third axis that is orthogonal to the second axis when viewed in a direction of the first axis, and each of the plurality of nozzles branches off from a corresponding local flow path.

9. A liquid ejecting apparatus comprising:

the liquid ejecting head according to claim 1; and a circulation mechanism that collects the liquid from either one of the first common liquid chamber and the second common liquid chamber and that recirculates the liquid to the other one of the first common liquid chamber and the second common liquid chamber.

10. A liquid ejecting head comprising:

a plurality of nozzles that eject a liquid along a first axis;

a row of individual flow paths that includes a plurality of individual flow paths arranged in parallel along a second axis orthogonal to the first axis when viewed in a direction of the first axis, the row of individual flow paths each being provided to a corresponding one of the plurality of nozzles;

a plurality of energy generating portions that generate energy to eject the liquid, the plurality of energy generating portions each being provided to a corresponding one of the plurality of nozzles;

a first common liquid chamber that is commonly in communication with the plurality of individual flow paths; and a second common liquid chamber that is commonly in communication with the plurality of individual flow paths, wherein the plurality of individual flow paths include a first individual flow path and a second individual flow path that are adjacent to each other in the row of individual flow paths, in the first individual flow path, a first energy generating portion in the plurality of energy generating portions is provided midway of a first communication flow path that communicates the first common liquid chamber and a first nozzle in the plurality of nozzles with each other, and a flow path length of the first communication flow path is shorter than a flow path length of a second communication flow path that communicates the second common liquid chamber and the first nozzle with each other, and in the second individual flow path, a second energy generating portion in the plurality of energy generating portions is provided midway of a third communication flow path that communicates the second common liquid chamber and a second nozzle in the plurality of nozzles with each other, and a flow path length of the third communication flow path is shorter than a flow path length of a fourth communication flow path that communicates the first common liquid chamber and the second nozzle with each other.

11. A liquid ejecting head comprising:

a first nozzle and a second nozzle that eject a liquid;

a first common liquid chamber commonly in communication with the first nozzle and the second nozzle;

a second common liquid chamber commonly in communication with the first nozzle and the second nozzle;

a first communication flow path that communicates the first nozzle and the first common liquid chamber with each other;

a second communication flow path that communicates the first nozzle and the second common liquid chamber with each other;

a third communication flow path that communicates the second nozzle and the second common liquid chamber with each other;

a fourth communication flow path that communicates the second nozzle and the first common liquid chamber with each other;

a first energy generating portion provided at a position corresponding to the first communication flow path; and a second energy generating portion provided at a position corresponding to the third communication flow path, wherein an inertance of the first communication flow path is smaller than an inertance of the second communication flow path, and an inertance of the third communication flow path is smaller than an inertance of the fourth communication flow path.

* * * * *